US007220172B2

(12) United States Patent
Kirschhoffer et al.

(10) Patent No.: US 7,220,172 B2
(45) Date of Patent: May 22, 2007

(54) DETAIL SANDING BLOCK

(75) Inventors: Jon A. Kirschhoffer, White Bear Lake, MN (US); Eric R. Cybulski, Woodbury, MN (US); Ryan Patrick Simmers, Cottage Grove, MN (US); Jonathan M. Lise, Woodbury, MN (US); Bernard A. Gonzalez, St. Paul, MN (US); Ian R. Owen, Baldwin, WI (US); Jenny L. Hicks, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/118,638

(22) Filed: Apr. 29, 2005

(65) Prior Publication Data

US 2006/0246826 A1 Nov. 2, 2006

(51) Int. Cl.
*B24B 1/00* (2006.01)

(52) U.S. Cl. ..... 451/59; 451/499; 451/512

(58) Field of Classification Search ..... 451/59, 451/514–525, 490, 499, 458; 15/231
See application file for complete search history.

(56) References Cited

U.S. PATENT DOCUMENTS

| | | | | |
|---|---|---|---|---|
| 1,844,996 | A * | 2/1932 | Walker | 451/503 |
| 2,435,335 | A * | 2/1948 | Andrews | 451/493 |
| 2,492,602 | A * | 12/1949 | Stenberg et al. | 451/492 |
| 2,742,744 | A * | 4/1956 | Applegate | 451/515 |
| 4,077,165 | A | 3/1978 | Hutchins | |
| 4,527,360 | A | 7/1985 | Dicke | |
| 4,625,462 | A | 12/1986 | Fushiya et al. | |
| 5,134,809 | A * | 8/1992 | Morton et al. | 451/523 |
| 5,172,524 | A * | 12/1992 | Poss | 451/504 |
| 5,437,571 | A | 8/1995 | Everts et al. | |
| 5,522,763 | A * | 6/1996 | Regnier | 451/502 |
| 6,613,113 | B2 | 9/2003 | Minick et al. | |
| 6,641,469 | B2 * | 11/2003 | Deshler | 451/514 |
| 2002/0037691 | A1 | 3/2002 | Mayr et al. | |

FOREIGN PATENT DOCUMENTS

| | | |
|---|---|---|
| DE | 198 00 044 A1 | 9/1998 |
| DE | 103 53 682 A1 | 6/2005 |
| GB | 2305876 A | 4/1997 |
| GB | 2 398 260 A | 8/2004 |

* cited by examiner

*Primary Examiner*—Dung Van Nguyen
(74) *Attorney, Agent, or Firm*—David B. Patchett

(57) ABSTRACT

A hand-held, manually-operated, sanding tool that can be used with conventional rectangular or square shaped sheet-like abrasive media to sand corners or other confined areas includes a base member having at least one tapered end and includes means for securing the sheet-like abrasive media to the tool.

15 Claims, 3 Drawing Sheets

DETAIL SANDING BLOCK

BACKGROUND

The present invention relates generally to hand-held, manually-operated, sanding tools that are used with a sheet of abrasive material such as sandpaper.

Abrasive sheets, such as conventional sandpaper, are commonly used to hand sand or finish a work surface, such as a wooden surface. In hand sanding the user holds the sandpaper directly in his or her hand to move the sandpaper across the work surface. Sanding by hand can, of course, can be an arduous task. To facilitate the hand sanding process, the sandpaper may be placed on a sanding block. Sanding blocks hold the sandpaper and can be more comfortably grasped by the user to make hand sanding faster and easier. A commercially available hand sanding block is the 3M™ Rubber Sanding Block available from 3M Company, St. Paul, Minn.

Conventional sanding blocks are typically rectangular or square and therefore have a square or rectangular sanding surface. These shapes allow them to be used with conventional abrasive sheets, which are also typically available in rectangular or square sheets. While such shapes are well suited for sanding flat open surfaces that are generally free of obstructions, they do not lend themselves to sanding confined or otherwise hard-to-reach areas, such as corners, or sanding around obstructions.

Known sanding blocks also suffer from additional drawbacks or shortcomings. For example, tensioning the abrasive media is a desirable feature of sanding blocks. With known sanding blocks, however, it is often difficult to load the abrasive media and secure it tightly to the block. If the media is not tight, it may wrinkle, and the wrinkles may snag on the work surface and cause the abrasive media to tear. In addition, wrinkles in the abrasive media may cause the work surface to be damaged or sanded unevenly.

Known sanding blocks may also require both ends of the abrasive sheet to be installed on the sanding block simultaneously, which can require considerable dexterity. Known sanding blocks also tend to be difficult and/or expensive to manufacture. In addition, sanding blocks may damage the abrasive sheet as it is installed on the tool, or may not optimally utilize the full sanding area of the abrasive sheet.

Motor driven detail sanders are also known. U.S. Pat. No. 5,437,571 (Everts et al.), for example, discloses a motor driven oscillating tool for sanding a surface. A variety of motor driven detail sanders are also available commercially. Such power tools, however, are considerably more expensive than manually-operated sanding blocks. In addition, motor driven sanders require abrasive sheets that are custom designed to match the size and shape of the sanding tool. Such power sanders, and the abrasive sheets used with them, also typically come with their own attachment system, such as adhesive or a mechanical attachment system such as hook-and-loop fasteners, so that the abrasive sheet can be securely fastened to the tool. As such, conventional sheet-like abrasive material cannot be used with such power sanders.

There is a need for a hand-held, manually-operated, sanding block that can be used to sand confined areas, such as corners, or sand obstructed areas that cannot be easily sanded using conventional sanding blocks, that uses conventional square or rectangular sheet-like abrasive media, such as sandpaper, and that does not require the abrasive media to have a special attachment system to allow it to be used with the sanding block. There is also a need for such a sanding block that is easy and inexpensive to manufacture, that can tension the abrasive sheet, that securely holds the abrasive sheets, is comfortable to use, and allows worn abrasive sheets to be quickly and easily replaced.

It would be desirable to provide a versatile, hand-held, manually-operated sanding tool that can be used for general sanding of flat, open, unobstructed surfaces as well as for detail sanding of confined work surfaces, such as corners. It would also be desirable to provide a hand-held, manually-operated sanding tool that is inexpensive, easy to use, and uses flexible flat sheets of abrasive material, such as conventional sandpaper, as well as resilient flexible abrasive sheets that are thicker than conventional sandpaper, such as the sheet-like abrasive materials described in U.S. Pat. No. 6,613,113 (Minick et al.), that are generally rectangular or square. In addition, it would be desirable to provide such a sanding tool that can be manufactured easily, is comfortable to use, allows worn sheets to be quickly and easily replaced, and allows sheet-like abrasive materials to be secured tightly to the sanding tool without unnecessary slack and without damaging the abrasive sheet.

SUMMARY

The invention overcomes the above-identified limitations in the field by providing a versatile hand-held, manually-operated, sanding tool that is useful for sanding flat open surfaces as well as confined areas, such as corners or obstructed areas. In addition, the invention provides such a tool that uses conventional flat sheets of rectangular or square abrasive media rather than requiring custom cut shapes. Furthermore, the tool does not require the abrasive sheet to have its own attachment means, such as adhesive or a mechanical attachment system such as hook or loop fasteners, to allow the abrasive sheet to be used with the tool. That is, the sanding tool itself includes the attachment means necessary to allow any sheet-like abrasive media to be used with the tool. The attachment means allow the sheet-like media to be securely fastened to the tool and also pulls and tensions the sheet-like abrasive media so the media is held tightly against the tool. The tool is able to accommodate different types, widths, and thicknesses of sheet-like abrasive media. In addition, the sanding tool is simple to operate, requiring no special tools, and is designed to be easy to manufacture and assemble.

In one embodiment, the present invention provides a hand-held, manually-operated, sanding tool for use with sheet-like abrasive media comprising a base member having first and second opposed ends, a top surface, a bottom surface, and opposed side edges, wherein at least one of the first and second ends is tapered, and a mechanism for securing the sheet-like abrasive media to the tool adjacent the bottom surface. In one aspect, the bottom surface is generally planar and extends between the first and second ends.

In another embodiment, the bottom surface of the tapered end portion is angled upwardly toward the top surface in the direction away from the opposed end. In another aspect, the bottom surface of the tapered end portion is curved upwardly toward the top surface in the direction away from the opposed end. In a more specific aspect, the opposed side edges are generally parallel and the tapered end is defined by a pair of intersecting edges, thereby defining a generally triangular end portion. In a particular embodiment, the intersecting edges meet at an angle of no greater than about 90 degrees.

In a specific embodiment, the base member includes at least one inclined upper contact surface opposite the bottom surface adjacent one of the first and second ends arranged to form an acute angle with the bottom surface relative to the associated adjacent end, and the tool further includes a retaining mechanism pivotally connected with the base member. The retaining mechanism is movable between an open position wherein the retaining mechanism is spaced from the base member contact surface, thereby defining a gap between the base member upper contact surface and the retaining mechanism for receiving an end of the sheet of abrasive material, and a closed position wherein the retaining mechanism is moved toward the contact surface and is arranged adjacent the base member contact surface, and wherein the retaining mechanism includes a tensioning member arranged to slidably engage the contact surface. In this manner, when an end of a sheet of abrasive material is inserted into the gap between the base member and the retaining mechanism, and the retaining mechanism is moved from the open position to the closed position, the tensioning member engages the sheet of abrasive material, and as the retaining mechanism is further urged toward the contact surface, the tensioning member and abrasive sheet move upwardly along the inclined contact surface away from the associated end, thereby tightening the fit of the abrasive sheet against the bottom surface of the base member.

In one embodiment, the tensioning member comprises a flexible metal leaf spring. In a specific aspect of the invention, the tensioning member extends the width of the retaining mechanism. In another specific aspect, the leaf spring includes a gripping surface for enhancing the attachment force between the tensioning member and the sheet of abrasive material. In one aspect, the gripping surface comprises a plurality of the projections. In another aspect, the gripping surface comprises a smooth pliable surface.

In a specific embodiment, the base member includes first and second end portions, the first end portion top surface containing a cavity, and the tool further includes a first retaining mechanism connected with the base member front end portion movable between a first open position and a second closed position, the first retaining mechanism including a projection adapted for mating engagement with the cavity. In this manner, when a sheet of abrasive material is arranged between the first retaining mechanism and the base member, and the first retaining mechanism is moved to the second closed position, the abrasive sheet is pinched and thereby retained between the first retaining mechanism and the base member.

In another aspect, the present invention provides a method of manually sanding or finishing a work surface, comprising the steps of providing a hand-held, manually-operated, sanding tool for use with sheet-like abrasive media, the tool comprising (i) a base member having first and second opposed ends, a top surface, a bottom surface, and opposed side edges, wherein at least one of the ends is tapered, and (ii) a mechanism for securing the sheet-like abrasive media to the tool; providing a square or rectangular shaped sheet-like abrasive media; arranging the sheet-like abrasive media along the bottom surface of the tool; folding the abrasive media around the tapered end portion of the base member; securing the abrasive media to opposite ends of the tool; and manually moving the tool over the surface to be sanded.

In a more specific aspect of the invention, the sanding tool comprises locking means for maintaining the retaining mechanism in the closed position. The retaining mechanism includes a first end portion rotatably connected with the base member, wherein the first end portion includes a shoulder including a locking projection, and the base includes a stop portion arranged cooperatively with the locking projection to allow the retaining mechanism to be forcibly moved between the open position and the closed position, thereby maintaining the retaining mechanism in either the open position or closed position depending on which side of the stop portion the locking projection is located.

In another specific aspect of the invention, the base member or retaining mechanisms include an attachment member containing a C-shaped receiving slot for rotatably receiving a portion of the other of the base member and retaining mechanism being attached thereto. The retaining mechanism includes a cylindrical shaft sized to snap fit into the receiving slot to provide the rotatable connection between the retaining mechanism and the base member. The attachment members contain angled cut-out slots to facilitate a one-time snap-on attachment, and prevent the retaining mechanism from separating from the base member.

In another specific aspect, the present invention provides a sanding tool wherein the base member includes a pair of spaced raised support members having aligned holes and the retaining mechanism includes a pair of attachment members having protrusions configured for snap-fit mating relation with the aligned holes of the support members, thereby allowing the tool to be manually assembled by snap fitting the retaining mechanism to the base member.

BRIEF DESCRIPTION OF THE DRAWINGS

The present invention will be further described with reference to the accompanying drawings, in which.

DETAILED DESCRIPTION

Figure 1:
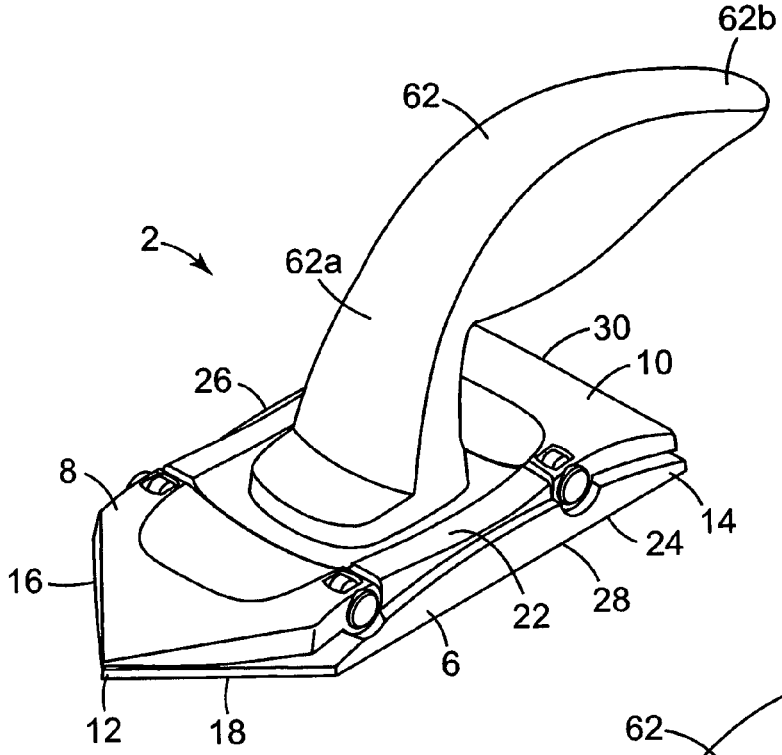
FIG. 1 is a perspective view of a hand-held manually-operated sanding tool according to the invention.

Referring now to the drawings, wherein like reference numerals refer to like or corresponding parts throughout the several views, FIGS. 1–5, show a hand-held, manually-operated sanding tool or sanding block 2 to which a flexible, replaceable, sheet-like abrasive material 4 (FIGS. 3 and 4) is secured. The term "manually-operated" refers to the fact that the tool 2 is not a power tool. That is, all of the power for the tool is provided by the user and the tool itself does not include a motor. The sanding tool 2 includes a base member 6 and retaining mechanisms 8, 10 pivotally connected with opposed front 12 and rear 14 ends of the base member 6. It will be recognized, however, that the present invention may be a power tool and is not limited to manually-operated tools.

In accordance with a characterizing feature of the tool 2, the front end 12 of the tool 2 is tapered (i.e. it narrows as it reaches its terminal end). In the illustrated embodiment, the tapered front end 12 is defined by a pair of intersecting edges 16, 18 that define a generally triangular end portion 20. The intersecting edges 16, 18 may be configured to meet at any angle, but because surfaces meeting at a 90 degree angle are common, having the intersecting edges 16, 18 meet at an angle of no greater than 90 degrees is desirable. In the illustrated embodiment, the edges 16, 18 are straight. Straight edges are desirable because they provide continuous support for the sheet-like abrasive media 4 when the media is attached to the tool 2. The intersecting edges 16, 18, however, may be curved, or the entire front end 12 of the tool 2 may be curved.

The base member 6 includes a top surface 22, a bottom surface 24, opposed side edges 26, 28, and a rear edge 30. In the illustrated embodiment, the opposed edges 26, 28 are parallel, and the rear edge 30 forms a 90 degree angle with the opposed edges 26, 28. When secured to the tool 2, the sheet-like abrasive material 4 is arranged along the bottom surface 24 of the base member 6. The terms sheet-like abrasive material and abrasive sheet refer to thin, flexible, generally square or rectangular sheets of abrasive material having discrete ends that can be attached to a sanding block. Such sheet-like abrasive material include, for example, conventional sandpaper, flexible sanding scrims, non-woven abrasive materials such as Scotch-brite™ available from 3M Company, St. Paul, Minn., and thin flexible abrasive sheet materials such as those described in U.S. Pat. No. 6,613,113 (Minick et al.), the entire contents of which are hereby incorporated by reference. The tool may also find use with non-abrasive sheet-like materials such as dust removing tack cloths. The term, however, does not include so called endless belts of abrasive material commonly used on power sanding tools, die cut sheets that are sold pre-cut to match the size and shape of a particular sanding tool as is commonly done for power detail sanding tools, or abrasive sheets having their own attachment means, such as adhesive or hook and loop type fasteners, that allow such abrasive sheets to be attached to a tool.

Figure 3:
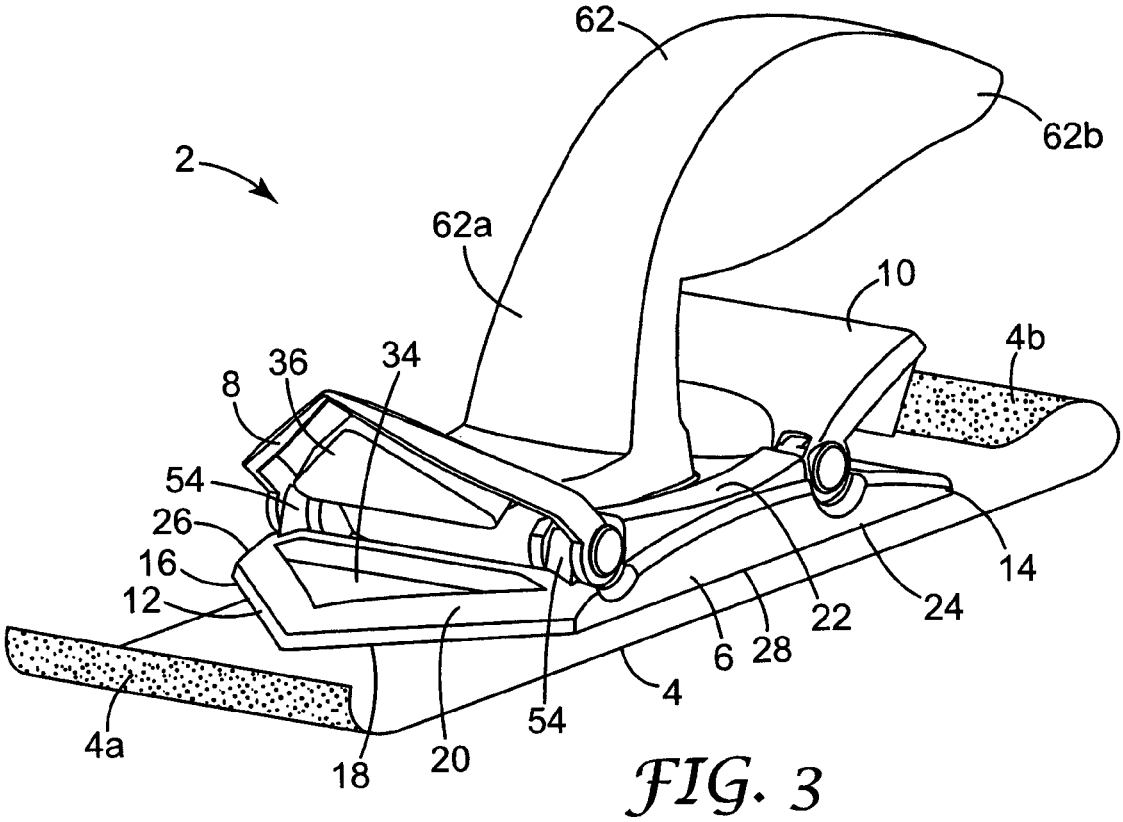
FIG. 3 is a perspective view of the sanding tool of FIG. 1 shown with the retaining mechanisms in their open positions.

As shown in FIG. 3, the top surface 22 of the triangular end portion 20 of the base member 6 contains a cavity 34, and the bottom surface of the associated retaining mechanism 8 includes a mating projection 36 that fits into the cavity 34. Thus, to attach the sheet-like abrasive material 4 to the tapered front end 12 of the tool 2, an end 4*a* of the abrasive material 4 is placed between the triangular end portion 20 of the base member 6 and the retaining mechanism 8 and the retaining mechanism 8 is lowered toward the base member 6, whereby the mating projection 36 forces the abrasive sheet 4 into the cavity 34, thereby providing a secure attachment of one end of the abrasive material 4 to the tool 2. In the illustrated embodiment, the cavity 34 and the mating projection 36 are generally triangular. Other shapes, such as a square, circle, etc. may also be used. In addition, the cavity 34 or the projection 36 may optionally include a gripping feature that serves to increase the frictional force between the tool and the abrasive material 4, thereby improving the holding force for retaining the abrasive material 4 in the tool. Other retaining mechanisms are contemplated in connection with the present invention. The retaining mechanisms could be, for example, clips, clamps, pins, adhesive, hook and loop type fasteners, or combinations thereof.

As shown in FIGS. 2, 4, 5*a* and 5*b*, the top surface 22 of the rear end 14 of the base member 6 has an inclined or angled contact surface 40 opposite the bottom surface 24. In this manner, the contact surface 40 and bottom surface 24 form an acute angle relative to the rear edge 30.

Each retaining mechanism 8, 10 is pivotally connected with an opposite end 12, 14 of the base member 6, respectively, thereby defining a jaw into which the ends 4*a*, 4*b* of the sheet-like abrasive material 4 may be inserted. Each retaining mechanism 8, 10 is movable between an open position (shown in FIGS. 3 and 4) and a closed position (shown in FIG. 1). In the open position, the retaining mechanisms 8, 10 are spaced from the base member 6, thereby defining gaps 42, 43 between the base member 6 and the associated retaining mechanism 8, 10. The gaps 42, 43 are sized to receive the ends 4*a*, 4*b* of the sheet-like abrasive material 4 which typically has a thickness of less than about 10 millimeters (mm), more typically, about 0.1 mm to about 8 mm, and even more typically about 0.5 mm to about 5 mm. In the closed position, the retaining mechanisms 8, 10 are moved toward the base member 6, and, when no abrasive material is present, are arranged adjacent to the base member 6.

Figure 4:
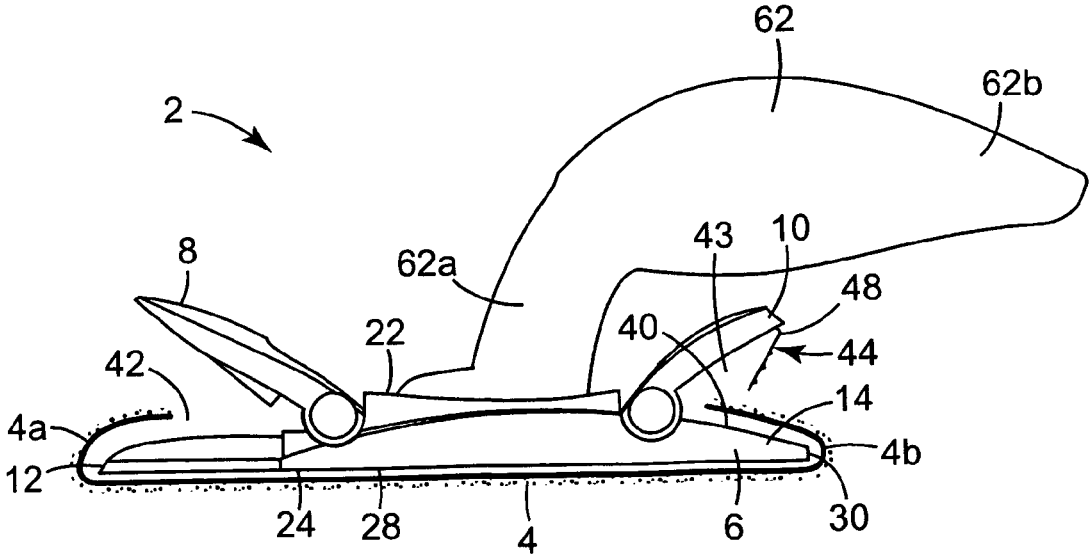
FIG. 4 is a side view of the sanding tool of FIG. 1 shown with a sheet of abrasive material being installed thereon.

To install a conventional square or rectangular shaped sheet-like abrasive media 4 on the tool 2 so that a corner or the like can be sanded, the sheet-like abrasive media 4 is arranged along the bottom surface 24 of the tool 2 as shown in FIGS. 3 and 4. The end 4*a* of the abrasive media 4 is then folded around the tapered front end 12 of the base member 6, one corner at a time, so the abrasive sheet 4 follows along each edge 16, 18 of the tapered front end 12, and thereby forms a tapered or pointed end that follows the contour of the tapered front end 12 of the tool 2. Once both corners of the abrasive media 4 have been folded up and around the edges 16, 18 and into the gap 42 defined between the retaining mechanism 8 and the contact surface of the base member 6, the retaining mechanism 8 is lowered until the end 4*a* of the abrasive media 4 is forced into the cavity 34 by the mating projection 36. In this manner, the first end 4*a* of the abrasive sheet 4 is pinched between the retaining mechanism 8 and the base member 6, and is thereby secured to the tool 2. Next, the second end 4*b* of the abrasive sheet 4 is inserted into the gap 43 defined between the retaining mechanism 10 and the rear end 14 of the base member 6. The retaining mechanism 10 is then lowered to secure the abrasive sheet to the tool 2 and tension the abrasive sheet 4 as explained in more detail below.

A flexible tensioning member 44 is arranged on the under side of the retaining mechanism 10 such that it faces the contact surface 40. Arranged in this manner, as the retaining mechanism 10 is lowered toward the base member 6 to attach the abrasive sheet 4 to the tool 2, the tensioning member 44 slidably engages the contact surface 40. When the end 4*b* of the sheet of abrasive material 4 is inserted in the gap 43 between the base member 6 and the retaining mechanism 10, and the retaining mechanism is moved from its open position to its closed position, the tensioning member 44 will engage the end 4*b* of the sheet of abrasive material 4, and as the retaining mechanism 10 is further urged downwardly toward the contact surface 40, the tensioning member 44 and abrasive sheet 4 will move upwardly along the inclined contact surface 40 away from the edge 30, thereby drawing the sheet of abrasive material 4 farther into the gap 43. In this manner, slack in the abrasive sheet 4 is taken up, thereby tightening the fit of the abrasive sheet 4 against the bottom 24 of the base member 6.

In the illustrated embodiment, the tensioning member 44 is a thin flexible strip of metal, such as a leaf spring, that generally returns to its original position when the applied force is released. Other materials such as a stiff rubber or synthetic plastic may also be used. To distribute the force applied by the tensioning member 44 evenly across the end abrasive sheet 4*b* (both during the installation of the abrasive sheet 4 onto the tool and while the abrasive sheet 4 is being held onto the tool during use), the tensioning member 44 preferably extends substantially continuously across the entire width of the retaining mechanism 10. By distributing the force in this manner, the tensioning member 44 has a reduced tendency to tear or otherwise damage the abrasive sheet material 4.

To further reduce the likelihood that the end of the tensioning member 44 will dig into the abrasive sheet 4, and thereby possibly damage the abrasive sheet, in an alternate embodiment, the tensioning member 44 may be curved or bowed inwardly such that the tensioning member 44 has a curved surface that faces the contact surface 40, and engages the contact surface when the retaining mechanism 10 is closed.

To increase the coefficient of friction between the tensioning member 44 and the abrasive sheet 4, and thereby improve the ability of the tensioning member 44 to firmly grip the abrasive sheet 4 and securely hold the abrasive sheet 4 both as the abrasive sheet 4 is installed on the tool 2 and during use after the abrasive sheet is installed on the tool 2, the tensioning member 44 may optionally include a gripping surface 48. In the illustrated embodiment, the gripping surface 48 comprises a plurality of projections. Alternatively, the gripping surface 48 may comprise, for example, a smooth pliable surface formed of, for example, rubber.

Figure 5A:
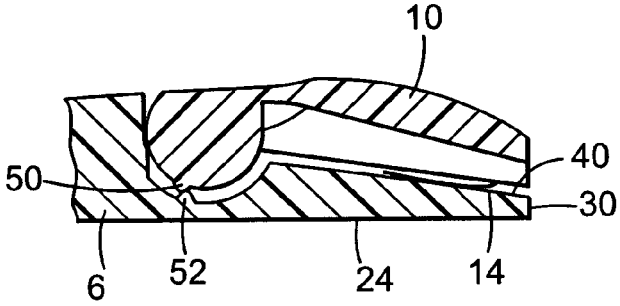
FIGS. 5*a* and 5*b* are detailed sectional views showing the locking means between the base member and a retaining mechanism.
Figure 5B:
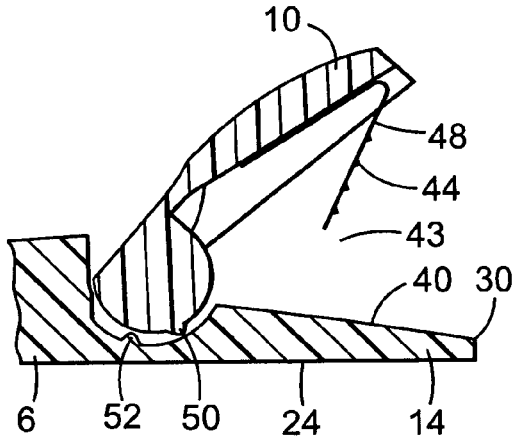

As shown in detail in FIGS. 5*a* and 5*b*, the tool 2 includes locking means comprising cooperating projections 50, 52. More particularly, with reference to retaining mechanism 10, the retaining mechanism 10 includes a movable locking projection 50 and the base member 6 includes a fixed stop projection 52. The cooperating projections 50, 52 are arranged in abutting relation to provide locking means to maintain the retaining mechanisms 8, 10 in either their opened or closed positions. When the retaining mechanism 10 is arranged in its open position (i.e., spaced from the associated contact surface 40 as shown in FIG. 5*b*), the projection 50 is positioned below in a counterclockwise direction from the cooperating base member projection 52. As the retaining mechanism 10 is rotated downwardly toward the associated contact surface 40 to its closed position, the projection 50 rotates and abuts the cooperating base member projection 52, which is a fixed portion of the base member 6.

As the retaining mechanism 10 is further urged downwardly toward the associated contact surface 40, the retaining mechanism 10 projection 50 is forced past the base member projection 52 until the retaining mechanism 10 projection 50 is positioned above in a clockwise direction from the base member projection 52 as shown in FIG. 5*a*. As this occurs, the retaining mechanism 10 snaps from its open position to its closed position adjacent the contact surface 40. Once in the closed position, the projections 50, 52 tend to maintain the retaining mechanism 10 in the closed position until the retaining mechanism 10 is forced open and the retaining mechanism projection 50 is once again positioned below—in a counterclockwise direction from—the base member projection 52.

The projections 50, 52 allow the retaining mechanisms 8, 10 to be repeatedly opened and securely closed—quickly and easily—each time a worn sheet of abrasive material 4 is removed from the tool 2 and replaced with a new sheet. In addition, by providing the tool 2 with independently actuated retaining mechanisms 8, 10, the ends of a sheet of abrasive material can be loaded into the tool 2 separately, one end at a time. That is, in contrast to some currently available sanding blocks, a user is not required to insert both ends of the abrasive sheet into the tool simultaneously, and then clamp the ends of the abrasive sheet in the tool simultaneously to obtain a tight fit.

Figure 2:
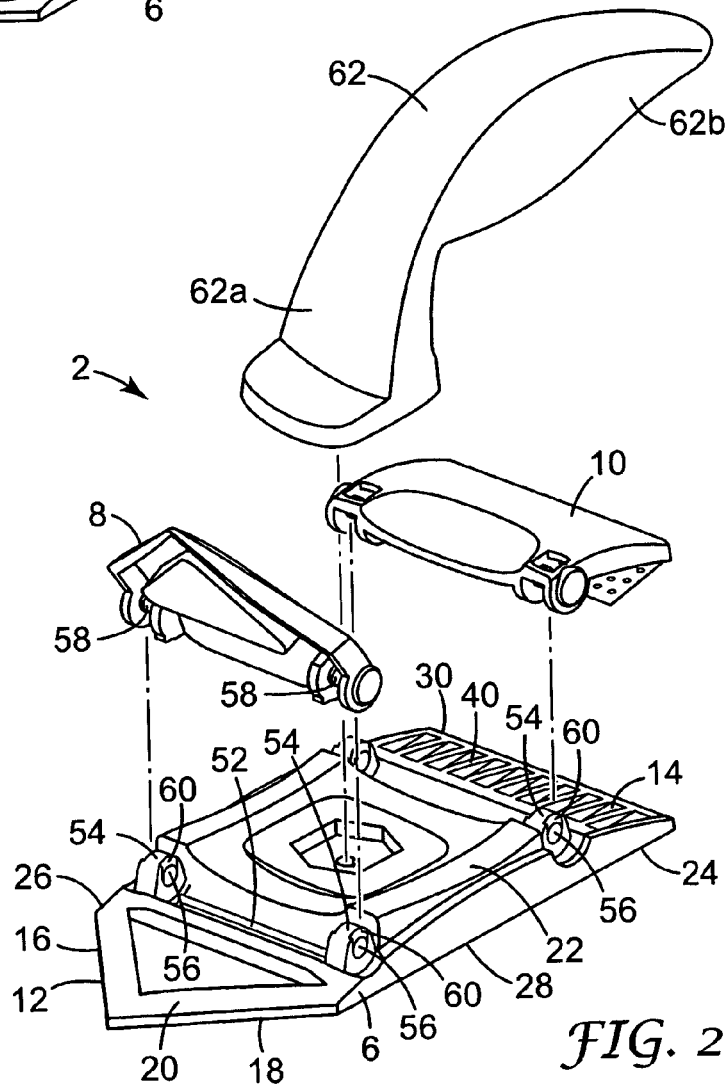
FIG. 2 is an exploded view of the sanding tool of FIG. 1.

Referring to FIG. 2, to provide the pivotal connection between the base member 6 and the retaining mechanisms 8, 10, the base member includes raised attachment members 54 containing through-bores 56 that rotatably receive protuberances 58 that are provided on the retaining mechanisms 8, 10. The protuberances 58 are sized to snap fit into the through-bores 56 to allow for quick and easy assembly of the tool 2. To provide a generally permanent attachment of the retaining mechanisms 8, 10 to the base member 6, the attachment members 54 contain angled slots 60 that allow the protuberances 58 to be easily pushed into the slots 60 and into mating relation with the through-bores 56, but make it difficult for the protuberances 58 to be removed or disengaged from the through-bores 56. It will be recognized that other snap fit connections may be used to attach the retaining mechanisms 8, 10 to the base member 6. For example, the base member 6 may include a pair of spaced raised support members having aligned channels, and the retaining mechanisms may include a shaft configured to snap-fit in rotatable mating relation with the aligned channels of the support members. In addition, the tool may have a unitary one-piece construction in which the pivotal connection between the base member 6 and the retaining mechanisms 8, 10 is provided by a living hinge.

The tool 2 also includes a handle 62. In the illustrated embodiment, the handle 62 includes a neck portion 62*a* that extends upwardly from a central region of the base member 6, and includes an elongated head portion 62*b* located at the end of the neck 62*a* that defines a hand gripping portion that can be readily grasped by a user to maneuver and control the movement of the tool 2.

Figure 6:
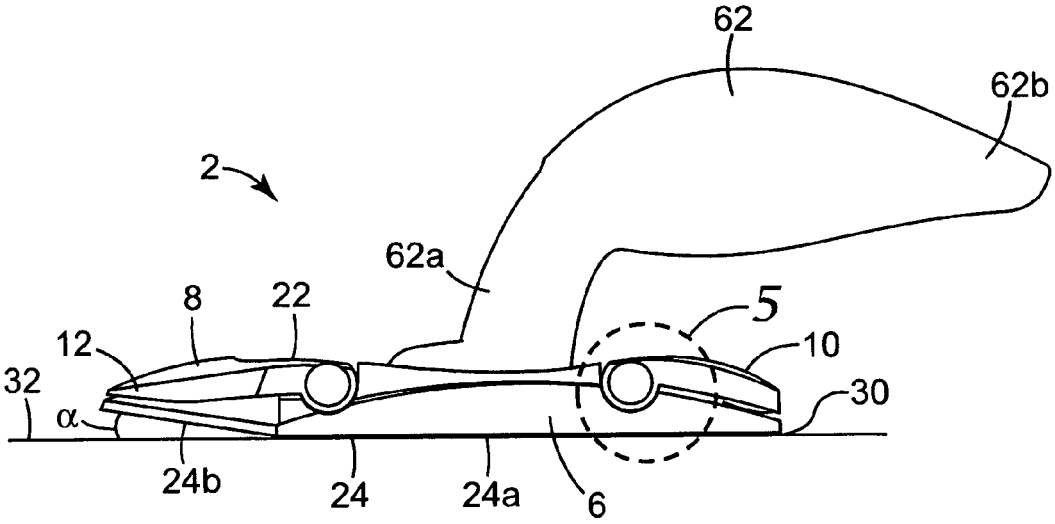
FIG. 6 is a side view of a second embodiment of the invention in which the front end portion of the sanding tool is angled upwardly.

In the embodiment illustrated in FIGS. 1–5, the bottom surface 24 is generally planar and extends between the front and rear ends 12,14 of the tool 2. Alternatively, as shown in FIG. 6, the bottom surface 24 of the tapered front end portion 12 may be angled upwardly toward the top surface 22. Configured in this manner, the bottom surface 24 of tool 2 is divided into a primary sanding surface 24*a* that extends from the triangular end portion 20 to the rear edge 30, and a secondary sanding surface 24*b* corresponding to the bottom surface of the triangular end portion 20. Thus, when the tool 2 is resting on a work surface 32, the secondary sanding surface 24*b* is angled upwardly at an angle a away from the work surface 32, and is therefore not in contact with the work surface 32.

This angled arrangement of the bottom surface 24 allows the primary sanding surface 24*a* to be used for sanding flat open areas and allows the secondary sanding surface 24*b* to be used for sanding corners or other confined areas by simply tilting the tool 2 forward (i.e. in the direction of the tapered front end portion 12). This is useful because if the entire bottom surface 24 is flat, the sanding surface corresponding to the triangular end portion 20 has a tendency to wear more quickly than the remainder of the sanding surface, therefore requiring the entire sheet of abrasive material to be replaced if a confined area is to be sanded. By angling the secondary sanding surface 24*b* upwardly so that it does not normally contact the work surface 32, the secondary sanding surface 24*b* is preserved until it is needed to sand a confined area. That is, the user can control when the secondary sanding surface 24*b* is used and has the ability to use it only when it is needed, thereby increasing the overall life of the abrasive media 4. Thus, when the tool 2 is being used to sand flat open areas, only the primary sanding surface 24*a* is used, and the secondary sanding surface 24*b* is preserved until it is needed to sand a corner or other confined area.

In the embodiment illustrated in FIG. 6, the secondary sanding surface 24*b* is generally flat or planar. The secondary sanding surface 24*b*, however, may be curved, such that the secondary sanding surface 24*b* bends upwardly away from the work surface 32 toward its terminal end. This configuration has the added benefit of allowing the user to control how much of the secondary sanding surface 24*b* is used by controlling how far forward the tool is tilted. Thus, depending on the area to be sanded, the tool can be tilted forward either a little or a lot to accommodate the geometry of the particular area being sanded. That is, when the secondary sanding surface 24*b* is generally flat as shown in FIG. 6, the entire secondary sanding surface 24*b* will contact the work surface 32 simultaneously as the tool 2 is tilted forward regardless of the geometry of the area being sanded. When the secondary sanding surface 24*b* is curved, however, the tool can be tilted forward and the secondary sanding surface 24*b* can be advanced continuously into contact with the work surface 32 to whatever extent is needed for the area being sanded.

The tool 2, including the base member 6, retaining mechanisms 8, 10, and handle 62, may be formed of any suitable material including, for example, wood, metal, synthetic plastic, or a stiff rubber.

It will be apparent to those of ordinary skill in the art that various changes and modifications may be made without deviating from the inventive concept set forth above. Thus, the scope of the present invention should not be limited to the structures described in this application, but only by the structures described by the language of the claims and the equivalents of those structures.

What is claimed is:

1. A hand-held, manually-operated, sanding tool for use wit sheet-like abrasive media, comprising:

(a) a base member having first and second opposed ends, a top surface, a bottom surface, and opposed side edges, wherein at least one of the first and second ends is tapered inwardly from at least one of the side edges, whereby the width of the tapered end of the base member is reduced; and (b) a retaining mechanism pivotally connected with the base member for securing the sheet-like abrasive media to the tool adjacent the bottom surface.

2. A sanding tool as defined in claim 1, wherein the bottom surface is generally planar and extends between the first and second ends.

3. A sanding tool as defined in claim 1, wherein the bottom surface of the tapered end portion is angled upwardly toward the top surface in the direction away from the opposed end.

4. A sanding tool as defined in claim 1, wherein the bottom surface of the tapered end portion is curved upwardly toward the top surface in the direction away from the opposed end.

5. A sanding tool as defined in claim 1, wherein the opposed side edges are generally parallel and the tapered end is defined by a pair of intersecting edges, thereby defining a generally triangular end portion.

6. A sanding tool as defined in claim 5, wherein the intersecting edges meet at an angle of no greater than about 90 degrees.

7. A sanding tool as defined in claim 1, wherein the base member includes at least one inclined upper contact surface opposite the bottom surface adjacent one of the first and second ends arranged to form an acute angle with the bottom surface relative to the associated adjacent end, and the tool further comprises a retaining mechanism pivotally connected with the base member, the retaining mechanism being movable between an open position wherein the retaining mechanism is spaced from the base member contact surface, thereby defining a gap between the base member upper contact surface and the retaining mechanism for receiving an end of the sheet of abrasive material, and a closed position wherein the retaining mechanism is moved toward the contact surface and is arranged adjacent the base member contact surface, and wherein the retaining mechanism includes a tensioning member arranged to slidably engage the contact surface, whereby when an end of a sheet of abrasive material is inserted into the gap between the base member and the retaining mechanism, and the retaining mechanism is moved from the open position to the closed position, the tensioning member engages the sheet of abrasive material, and as the retaining mechanism is further urged toward the contact surface, the tensioning member and abrasive sheet move upwardly along the inclined contact surface away from the associated end, thereby tightening the fit of the abrasive sheet against the bottom surface of the base member.

8. A sanding tool as defined in claim 7, wherein the tensioning member comprises a flexible metal leaf spring.

9. A sanding tool as defined in claim 8, wherein the tensioning member extends the width of the retaining mechanism.

10. A sanding tool as defined in claim 9, wherein the leaf spring includes a gripping surface for enhancing the attachment force between the tensioning member and the sheet of abrasive material.

11. A sanding tool as defined in claim 10, wherein the gripping surface comprises a plurality of the projections.

12. A sanding tool as defined in claim 11, wherein the gripping surface comprises a smooth pliable surface.

13. A sanding tool as defined in claim 1, wherein the base member includes first and second end portions, the first end portion top surface containing a cavity, the tool further comprising a first retaining mechanism connected with the base member front end portion movable between a first open position and a second closed position, the first retaining mechanism including a projection adapted for mating engagement with the cavity, whereby when a sheet of abrasive material is arranged between the first retaining mechanism and the base member and the first retaining mechanism is moved to the second closed position, the abrasive sheet is pinched and thereby retained between the first retaining mechanism and the base member.

14. A method of manually sanding or finishing a work surface, comprising the steps of:

(a) providing a hand-held, manually-operated, sanding tool for use with sheet-like abrasive media, the tool comprising (i) a base member having first and second opposed ends, a top surface, a bottom surface, and opposed side edges, wherein at least one of the ends is tapered inwardly from at least one of the one side edges, whereby the width of the tapered end of the base member is reduced, and (ii) a mechanism for securing the sheet-like abrasive media to the tool;

(b) providing a square or rectangular shaped sheet-like abrasive media;

(c) arranging the sheet-like abrasive media along the bottom surface of the tool;

(d) folding the abrasive media around the tapered end portion of the base member;

(e) securing the abrasive media to the tool; and (f) manually moving the tool over the surface to be sanded.

15. A hand-held, manually-operated, sanding tool for use with sheet-like abrasive media, comprising:

(a) a base member having first and second opposed ends, a top surface, a bottom surface, and opposed side edges, wherein at least one of the first and second ends is tapered inwardly from at least one of the side edges and intersects the opposite side edge, thereby defining a generally triangular end portion; and (b) a mechanism for securing the sheet-like abrasive media to the tool adjacent the bottom surface.

* * * * *

UNITED STATES PATENT AND TRADEMARK OFFICE

CERTIFICATE OF CORRECTION

PATENT NO. : 7,220,172 B2
APPLICATION NO. : 11/118638
DATED : May 22, 2007
INVENTOR(S) : Jon A. Kirschhoffer It is certified that error appears in the above-identified patent and that said Letters Patent is hereby corrected as shown below:

Column 8,
Line 46, after "angle" delete "a" and insert --α-- therefor.

Column 9,
Line 36, delete "wit" and insert --with-- therefor.

Signed and Sealed this

Fourth Day of September, 2007

JON W. DUDAS
*Director of the United States Patent and Trademark Office*